US007108302B2

(12) United States Patent
Zingelmann

(10) Patent No.: US 7,108,302 B2
(45) Date of Patent: Sep. 19, 2006

(54) ANTI-THEFT SILL KNOB HOUSING AND CABLE ASSEMBLY FOR A VEHICLE

(75) Inventor: Kurt Zingelmann, Columbus, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/678,721

(22) Filed: Oct. 3, 2003

(65) Prior Publication Data

US 2005/0073158 A1 Apr. 7, 2005

(51) Int. Cl.
*E05B 9/00* (2006.01)

(52) U.S. Cl. ..... 292/337; 292/DIG. 2

(58) Field of Classification Search ..... 292/1, 292/336.3, 337, DIG. 2, 125, 225; 74/502.4, 74/502.6

See application file for complete search history.

(56) References Cited

U.S. PATENT DOCUMENTS 2,735,289 A * 2/1956 Trammell ..... 70/181
3,247,691 A * 4/1966 Martin ..... 70/181
4,169,620 A * 10/1979 Pacura ..... 292/347
4,628,300 A 12/1986 Amato
5,010,780 A * 4/1991 Hatfield ..... 74/501.5 R
5,435,609 A 7/1995 Igata et al.
D429,991 S * 8/2000 Short ..... D8/307
6,139,076 A * 10/2000 Hara et al. ..... 292/336.3
6,375,234 B1 * 4/2002 Brackmann et al. ..... 292/1
6,471,266 B1 10/2002 Yi
2002/0036408 A1 3/2002 Jang

* cited by examiner

*Primary Examiner*—Gary Estremsky
(74) *Attorney, Agent, or Firm*—Carrier, Blackman & Associates, P.C.; William D. Blackman; Joseph P. Carrier

(57) ABSTRACT

A sill knob and cable assembly, for interconnecting a lock button and a vehicle latch, includes a tubular sheath and a cable slidably disposed in the sheath. The cable has a sill knob attached to an upper end thereof. The sheath has a hollow housing attached to an upper end thereof for slidably receiving the sill knob. The housing includes a guide sleeve and a shield, integrally attached to the top of the guide sleeve, for limiting unauthorized access to the sill knob and the base of the lock button, when the vehicle is locked. The housing may also include a ledge extending between the shield and the top of the guide sleeve. The shield may be a cylindrical collar for protectively surrounding the sill knob when said sill knob is in a lowered position. A sleeved housing for use with a sill knob and cable assembly is also described.

12 Claims, 7 Drawing Sheets

ANTI-THEFT SILL KNOB HOUSING AND CABLE ASSEMBLY FOR A VEHICLE

BACKGROUND OF THE INVENTION

1. Field of the Invention

The present invention relates to locking hardware for vehicle doors. More particularly, the present invention relates to sill knob housings and to vehicular door latch-actuating sill knob and cable assemblies. Even more particularly, the present invention relates to a sill knob housing and door latch-actuating cable assembly which is adapted to resist unauthorized entry into a locked vehicle.

2. Description of the Background Art

Vehicle theft remains a problem in society today. Vehicle theft creates problems for owners of the targeted vehicles, as does the theft of items from within vehicles, such as purses, cell phones, CDs and other items. Unfortunately, certain individuals take advantage of vehicle owners by stealing from the vehicle, and/or may even steal the vehicle outright. Many times, a dismantled vehicle's parts may be worth more than the resale value of the stolen vehicle.

When these types of crimes occur, all drivers lose through increased insurance premiums.

Many times a flat metal tool, such as a "slim-jim" or ruler, is slipped between the window and the window seal by an unauthorized person, and the tool is then pushed, pulled or twisted to engage the locking device in the door. When this tool is engaged with the locking mechanism and pulled, pushed or twisted in the right spot (depending on the configuration of elements), the vehicle latch can be unlocked.

A number of different devices are known for discouraging unauthorized entry into a vehicle. Examples of some of previously known anti-theft door apparatus are given below.

U.S. Pat. No. 4,628,300 to Amato discloses a motor vehicle lock cover device having a cover strip running nearly the length of the door between the glass and door frame to prevent instruments from being inserted into the door to release the lock.

U.S. Pat. No. 5,435,609 to Igata et al. discloses an anti-theft apparatus for vehicle door lock having an anti-theft tube that covers the rod which locks and unlocks the vehicle opening.

U.S. Pat. No. 6,471,266 to Yi discloses a door latch cover for an automotive vehicle. The cover has an extended portion that prevents access to the door latch and actuator and eliminates a cover for the actuator.

Published U.S. Patent Application Ser. No. 2002/0036408 to Jang, which discloses an automotive door having a burglarproof structure designed to prevent the unauthorized entry to a vehicle opening. The device includes a slider and blocking plate which prevent access to a lock lever of the lock assembly.

Other issued patents relating to vehicle door locks and related hardware include U.S. Pat. Nos. 4,093,289, 4,238,133, 4,674,780, 4,813,727, 4,842,312, and 6,457,753.

Although the known devices have some utility for their intended purposes, a need still exists in the art for an improved device to secure the openings of vehicles. In particular, there is a need for an improved sill knob housing, and for an improved sill knob housing, and for a sill knob and cable assembly which will increase the security of vehicle locks.

SUMMARY OF THE INVENTION

The present embodiment of the invention provides a theft-deterrent apparatus for use with locks for vehicle openings. Examples of lockable vehicle openings that the present invention can be used with include pivotally opening doors, sliding doors, hatchbacks, and other openings that may use a locking sill knob.

A sill knob and cable assembly according to a first embodiment of the present invention resists unauthorized entry into a vehicle by the use of tools or implements. The tools used in the past are more difficult to successfully operate with the design and arrangement of elements according to the invention.

In an illustrative embodiment of the invention, a sill knob and cable assembly includes a tubular sheath, a cable slidably disposed in the sheath, a sill knob attached to an upper end of the cable, and a hollow housing attached to an upper end of the sheath, for slidably receiving the sill knob. In this embodiment, the housing at the upper end of the sheath includes a knob guide and a shield, integrally attached to the knob guide, for limiting unauthorized access to the base of the lock button and to the sill knob. This shield may be provided in the form of a cylindrical collar for protectively surrounding the sill knob when the vehicle is locked.

In a particular version of the sill knob and cable assembly according to the first embodiment, the sill knob guide is made in a substantially rectangular box shape, and the shield at the top of the sill knob guide is substantially cylindrical or oval in shape. The protective sleeve may be made in the shape of a partially flattened tube.

The present invention also relates to a sill knob housing for use as one component of a knob and cable assembly.

A sill knob housing, in accordance with another illustrative embodiment of the invention, includes a knob guide sleeve, a shield and a ledge which integrally connects the shield and the knob guide sleeve. The shield may be made in a different cross-sectional shape than the knob guide sleeve.

In the described embodiment of the sill knob housing, the knob guide sleeve includes a floor with a hole formed therethrough, and at least one wall extending upwardly from the floor and defining a hollow chamber for surrounding a base portion of a sill knob.

The shield is provided for substantially surrounding part of a sill knob in a locked position thereof. The shield is wider than the knob guide sleeve, and the ledge, where used, extends between the top of the guide sleeve and the shield.

In one embodiment of the invention, the sill knob guide is made in a substantially rectangular box shape, to receive a rectangular body of a sill knob. The shield may be substantially cylindrical, or may be made with an oval cross-section.

Accordingly, it will be seen that the present invention provides an apparatus for resisting vehicle break-ins.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENTS

Previous Cable and Sill Knob Assembly

Figure 1:
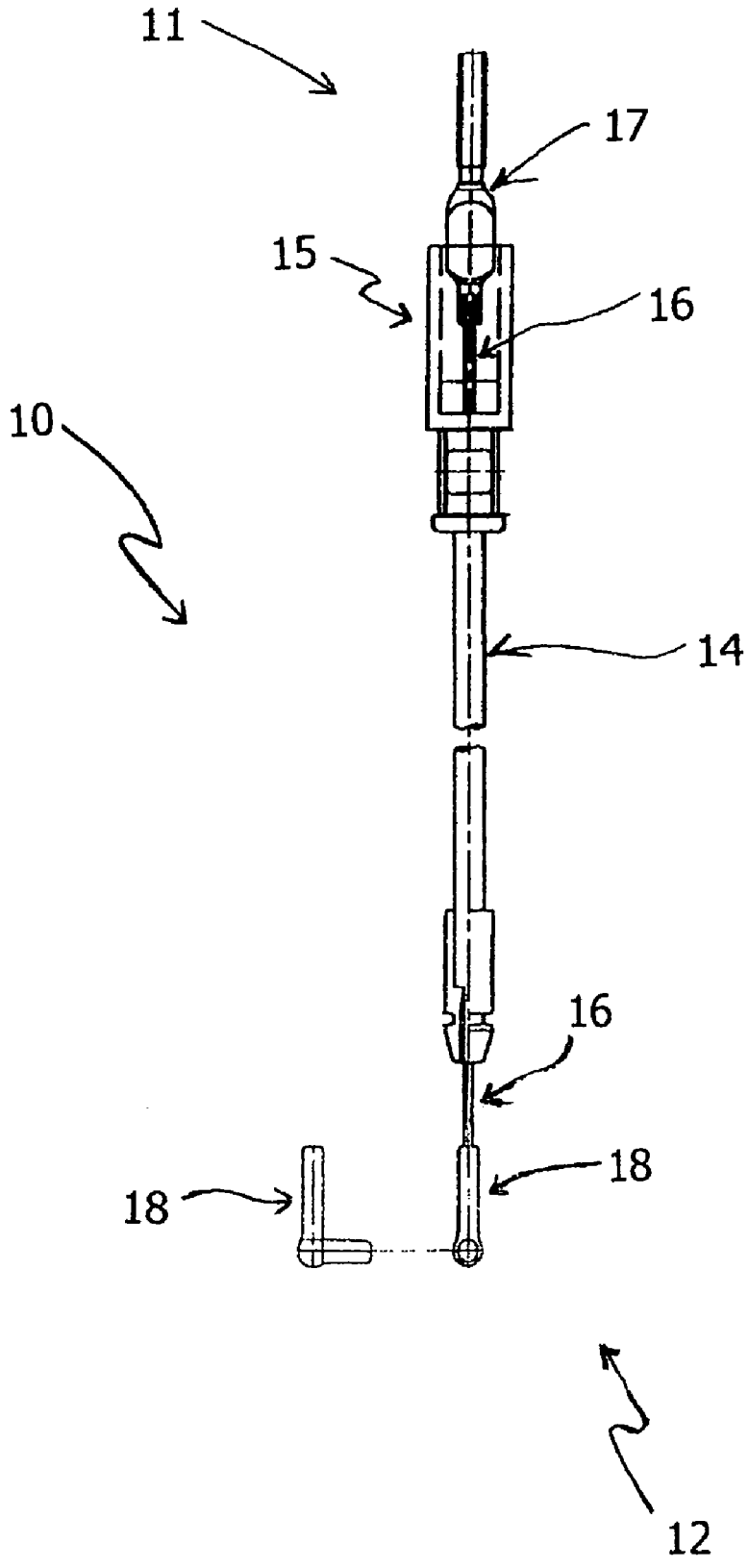
FIG. 1 is a front plan view, partially in cross section, of a sill knob and cable assembly according to a previous design of applicant.
Figure 4:
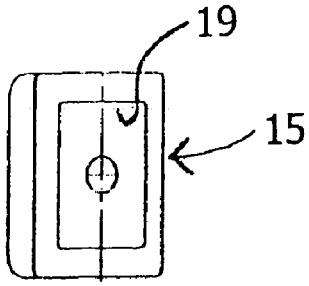
FIG. 4 is a top plan view of the sill knob housing of FIGS. 2–3.
Figure 3:
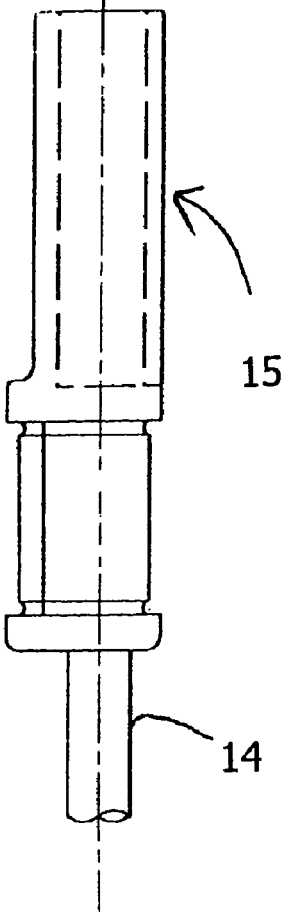
FIG. 3 is a side plan view of the sill knob housing of FIG. 2.
Figure 2:
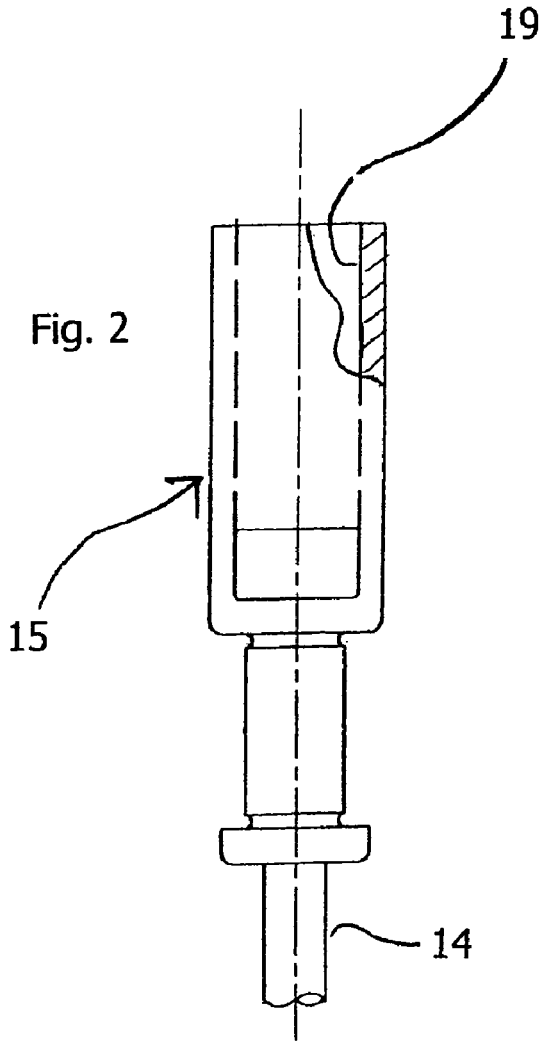
FIG. 2 is a detail view, partially in cross section, of a sill knob housing which is a component part of the assembly of FIG. 1.
Figure 5:
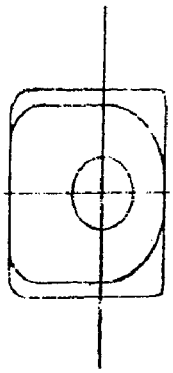
FIG. 5 is a bottom end plan view, partially in cross section, of the sill knob housing of FIGS. 2–3.

FIG. 1 illustrates a cable and sill knob assembly 10 according to an earlier design. One aspect of the present invention is an improvement on the cable and sill knob assembly of FIG. 1, as shown in other Figures of the drawings, and as will be further discussed herein.

As shown in FIG. 1, the cable and sill knob assembly 10 of the early design has an upper, user accessible end 11 which is made to support a lock button, and a lower actuation end 12, for attaching to an inner door latch mechanism (not shown).

The assembly 10 includes a hollow, tubular sheath 14, and also contains a wire cable 16 which is slidably movable inside the sheath. The cable 16 has a sill knob 17 affixed to the upper end thereof, for supporting a lock button thereon. The cable 16 also has a substantially L-shaped connector 18 affixed to the lower end thereof, for interacting with and inner door latch mechanism of a vehicle (not shown).

The upper end of the sheath 14 has a housing 15 affixed thereto. The housing 15 is made in a substantially rectangular box shape, as seen in FIGS. 2–5. The housing 15 has a hollow passage 19 formed therein (FIG. 2) to receive a base portion of the sill knob 17.

In the embodiment of FIGS. 1–5, the housing 15 is configured so that the width of the hollow passage 19 is constant throughout, and the housing terminates at the upper end of the rectangular box.

New Cable and Sill Knob Assembly

Figure 13:
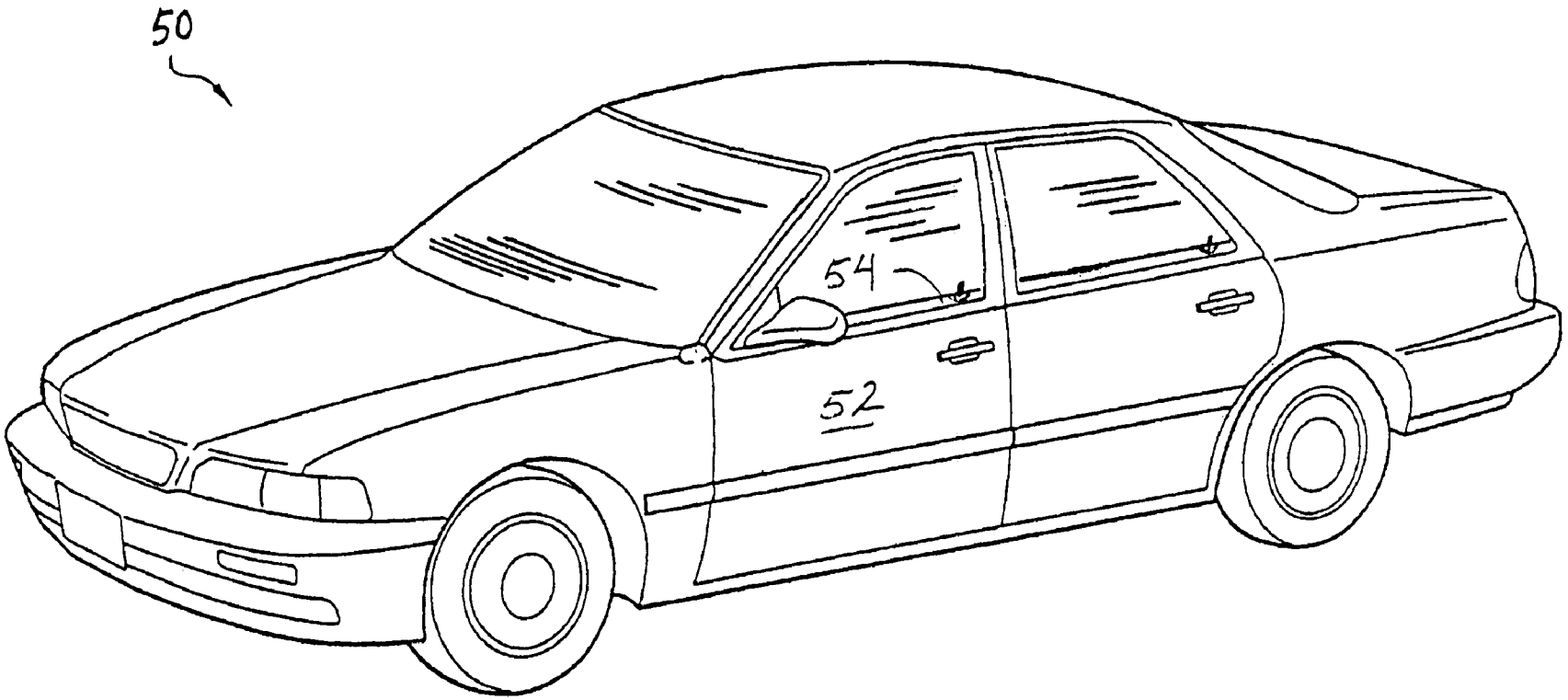
FIG. 13 is a perspective view of a vehicle incorporating a sill knob and cable assembly therein according to an illustrative embodiment of the invention.

FIG. 13 illustrates a vehicle 50 having a door 52, including a sill portion 54 disposed at the bottom of a window opening therein. The vehicle 50 incorporates a sill knob and cable assembly in the door 52, according to an illustrative embodiment of the invention.

Figure 7:
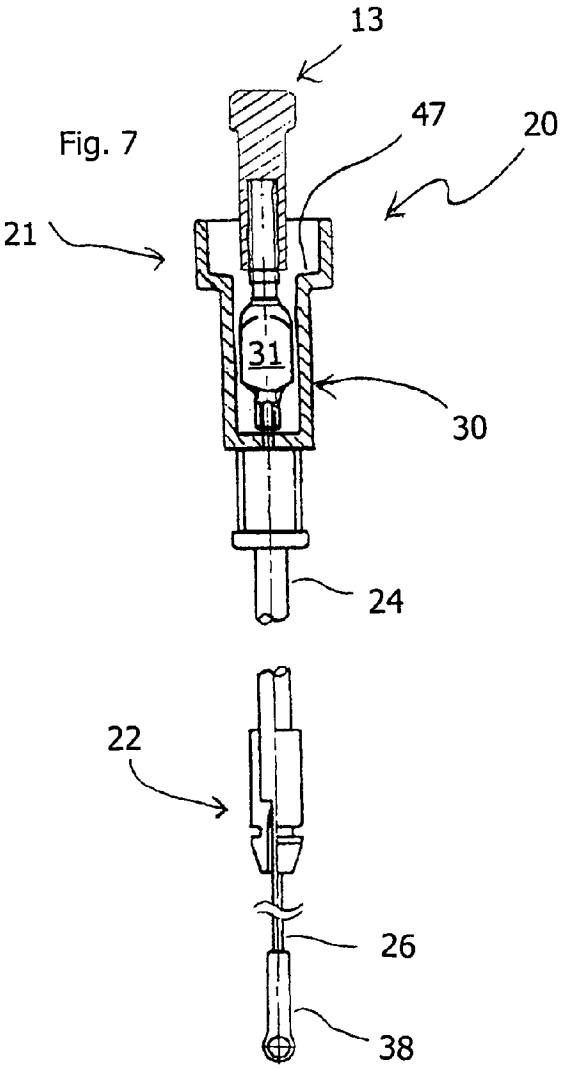
FIG. 7 is a view similar to FIG. 6, but showing the sill knob and lock button in a locked configuration thereof.
Figure 6:
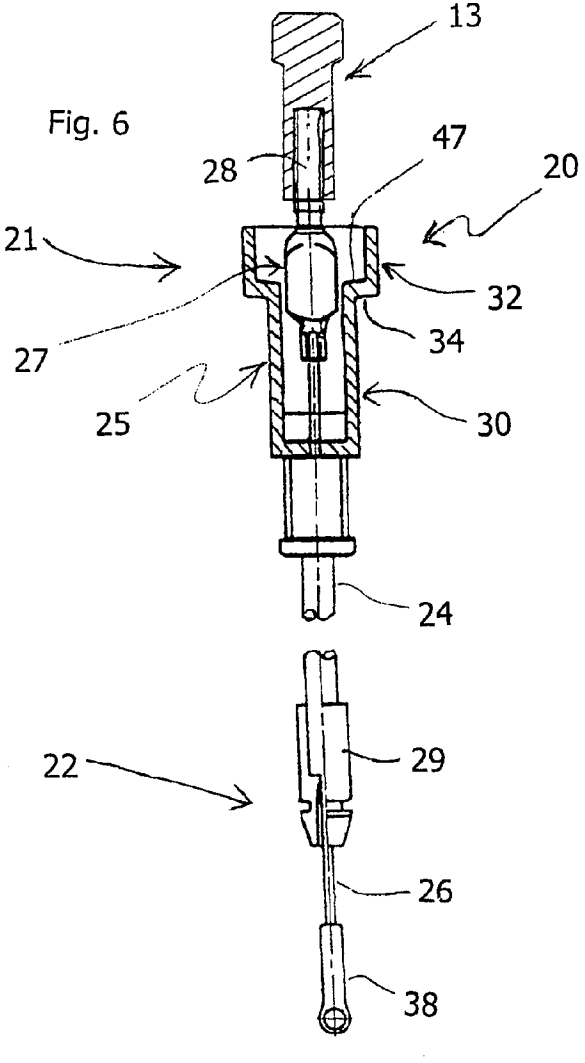
FIG. 6 is a front plan view, partially cut away and partially in cross section, of a sill knob and cable assembly according to an illustrative embodiment of the present invention, showing a sill knob and lock button in an unlocked configuration thereof.
Figure 8:
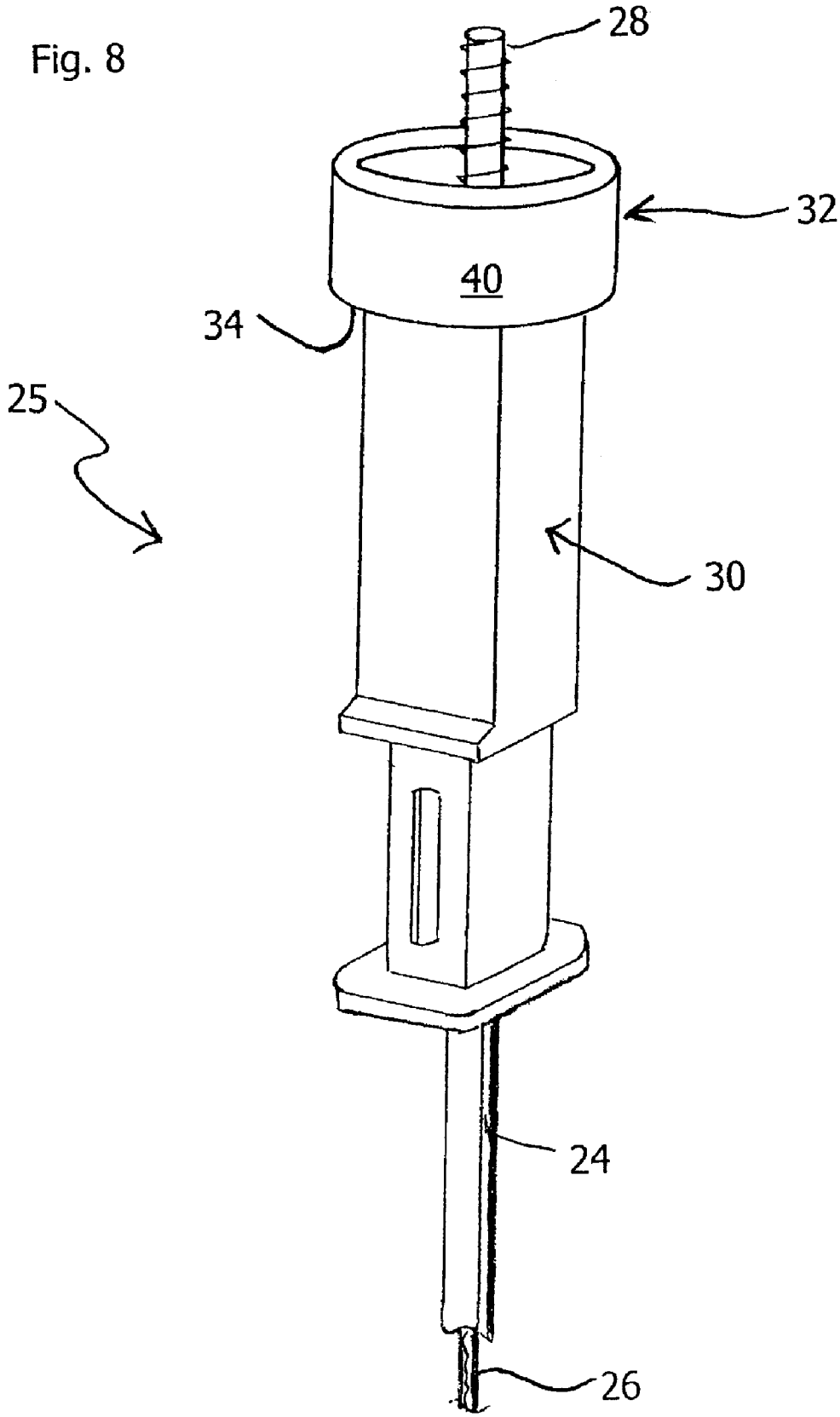
FIG. 8 is a perspective view of a sill knob housing, which is one component of the sill knob and cable assembly of FIGS. 6–7.

FIGS. 6 and 7 show an improved cable and sill knob assembly 20 according to the present invention. FIG. 6 shows the assembly 20 with the sill knob 27 in an unlocked position thereof, and FIG. 7 shows the assembly with the sill knob in a locked position.

The cable and sill knob assembly 20 in FIGS. 6–7 is shown in substantially the orientation in which it would be found mounted in the door of a vehicle.

Throughout the present specification, relative positional terms like 'upper', 'lower', 'front', 'rear', 'top', 'bottom', 'horizontal', 'vertical', and the like are used to refer to the orientation of the apparatus as shown in the drawings. These terms are used in an illustrative sense to describe the depicted embodiments, and are not meant to be limitative. It will be understood that the depicted apparatus may be placed at an orientation different from that shown in the drawings, such as inverted 180 degrees or transverse to that shown, and in such a case, the above-identified relative positional terms will no longer be accurate.

FIGS. 6 and 7 also illustrate a lock button 13 threadably mounted on a stud 28 of the sill knob 27. The lock button 13, per se, is not part of the cable and sill knob assembly 20. Instead, the lock button is 13 included in the drawing to help illustrate the use of the assembly 20.

As shown in FIGS. 6 and 7, the cable and sill knob assembly 20 has an upper, user accessible end 21 and a lower actuation end 22, with the two ends interconnected by a hollow, tubular sheath 24. The sheath 24 contains a wire cable 26, which is slidably movable in the hollow central portion thereof.

The sheath 24 has a cable guide 29 attached to the lower end thereof, and also has a housing 25 attached to the upper end thereof.

The housing 25 includes two main sections, a knob guide 30 at the lower end thereof for slidably receiving the sill knob 27, and a protective shield 32 attached to the upper end of the knob guide, with a sill 34 extending therebetween. Additional structure of the housing will be discussed in further detail below.

The Cable and Sill Knob

The cable 26 has a connector 38 attached to the lower end thereof, which is adapted to be attached to a vehicular lock mechanism (not shown). The sill knob 27 is attached to the top of the cable 26 at the upper end 21 of the assembly 20, and is slidably disposed in the knob guide 30. The stud 28 is provided at the upper end of the sill knob 27 for supporting a lock button 13 thereon, to allow a user to manually lock and unlock the lock mechanism for the vehicle opening.

This embodiment of the sill knob assembly 20 could also be used in conjunction with an electronic key fob operated locking and unlocking system (not shown).

The sill knob 27 may be crimped or welded on to the cable 26, or may be attached to the cable 26 in other known fashion.

The upper end of the cable 26 is attached to the base of the sill knob 27, and the cable then passes downwardly through the housing 25, and extends through the sheath 24. The cable 26 passes through a cable guide 29 at the base of the sheath 24, and terminates at a connector 38. The connector 38 is provided for attaching to a locking mechanism (not shown) for locking and un-locking the vehicle. The sill knob and cable assembly 20 is constructed and arranged such that when it is installed in a vehicle, and the sill knob 27 is pulled or pushed via the lock button 13, the cable 26 causes translation of the connector 38 and moves the locking mechanism (not shown) to lock or unlock the vehicle opening.

Figure 10:
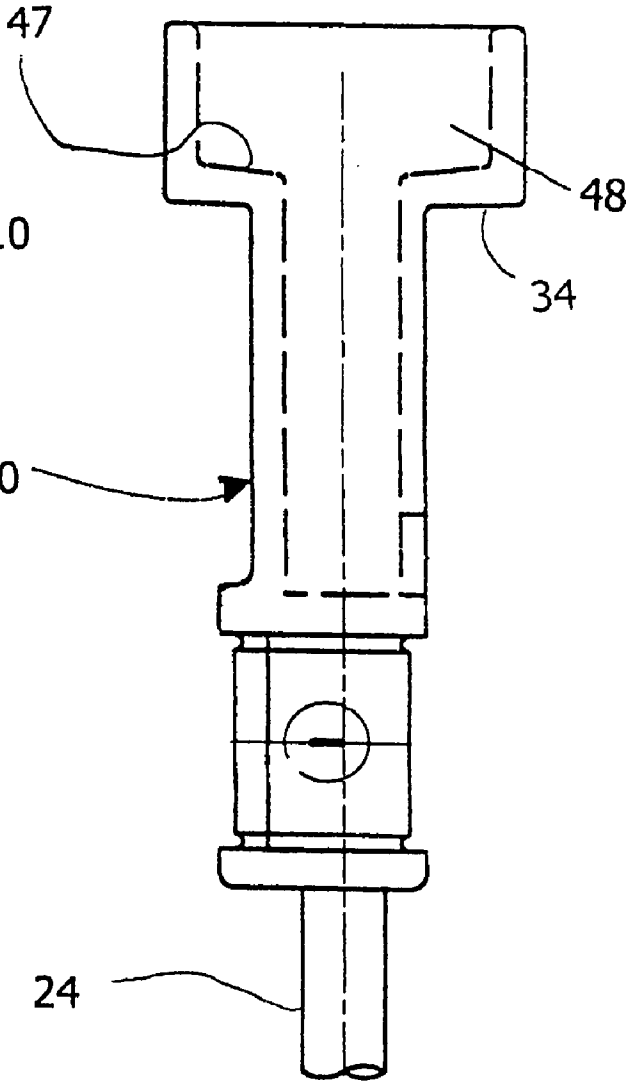
FIG. 10 is a side plan view of the sill knob housing of FIG. 8.

The sill knob 27 includes a main body 31 configured to fit slidably inside of the knob guide 30 of the housing 25. In the depicted embodiment, the main body 31 of the sill knob 27 has a rectangular cross-sectional shape with flat sides, to resist rotation in the knob guide 30. The knob guide 30 has a shape corresponding to that of the sill knob, as seen best in FIG. 10.

Other rotation-resistant shapes, which correspond to one another, may be used for the sill knob 27 and the knob guide 30. Examples of alternate cross-sectional shapes which may be used include triangular, tongue and groove, oval, etc. Whatever the shape chosen, the main body 31 of the sill knob 27 is configured to fit slidably inside of the knob guide 30, and the knob guide is made in a shape to closely conform to and slidably receive the sill knob 27.

As noted, the sill knob 27 also includes a stud 28 extending upwardly from the main body 31. The stud 28 has male threads formed externally thereon, to threadably support a lock button 13.

The Housing

As previously noted, the housing 25 includes the knob guide 30 for slidably receiving the sill knob 27, and also includes a protective shield 32 attached to the upper end of the knob guide, with a sill 34 extending therebetween. The shield 32 is generally wider than the knob guide 30, and may take the form of a substantially cylindrical collar 40, which substantially surrounds and encircles an upper portion of the sill knob 27 in the locked position thereof, as seen in FIG. 7.

Referring now to FIGS. 8–12, the knob guide 30 includes a floor portion 36 and at least one wall 43 attached to and extending upwardly from the floor portion, to define a chamber 41 for slidably receiving the main body 31 of the sill knob. Where the knob guide 30 is made in a substantially rectangular box shape, it will have four side walls 43, 44, 45, 46 extending upwardly from the outer edges of the floor portion 36.

Figure 9:
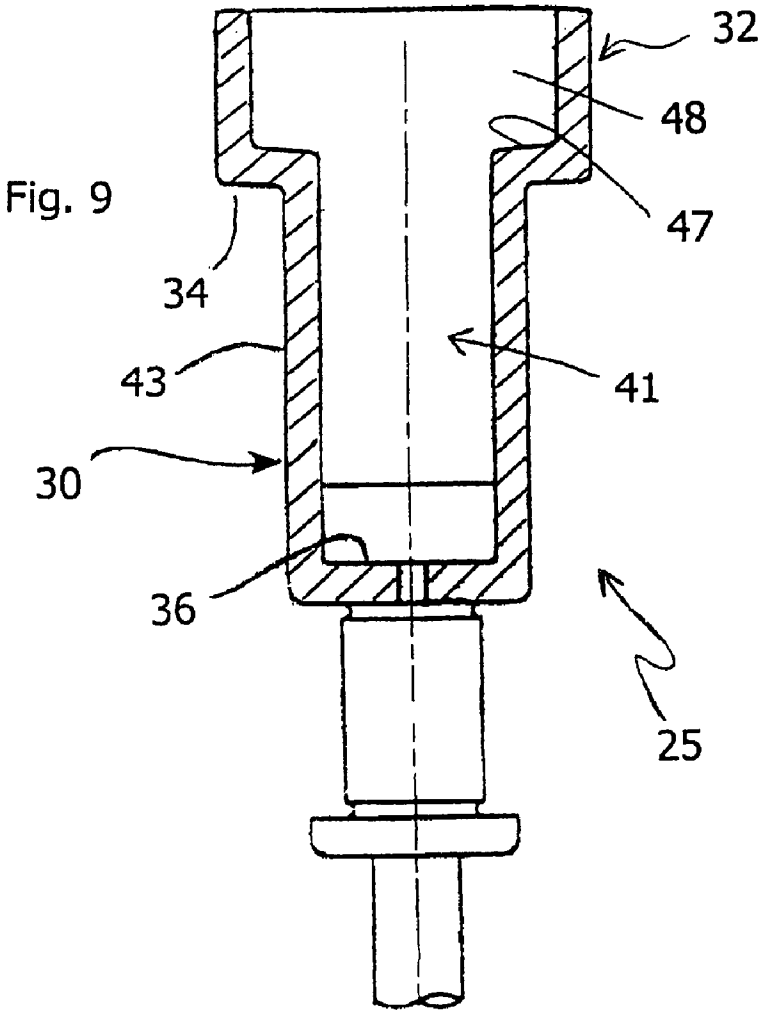
FIG. 9 is a front plan view, partially in cross-section, of the sill knob housing of FIG. 8.
Figure 11:
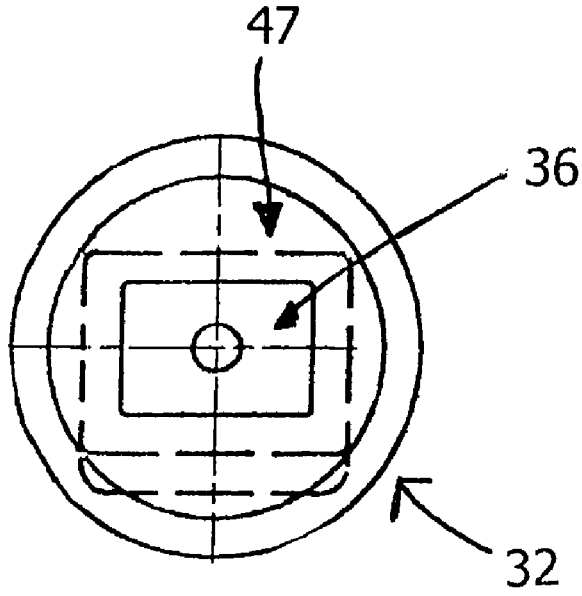
FIG. 11 a top plan view of the sill knob housing of FIG. 8.
Figure 12:
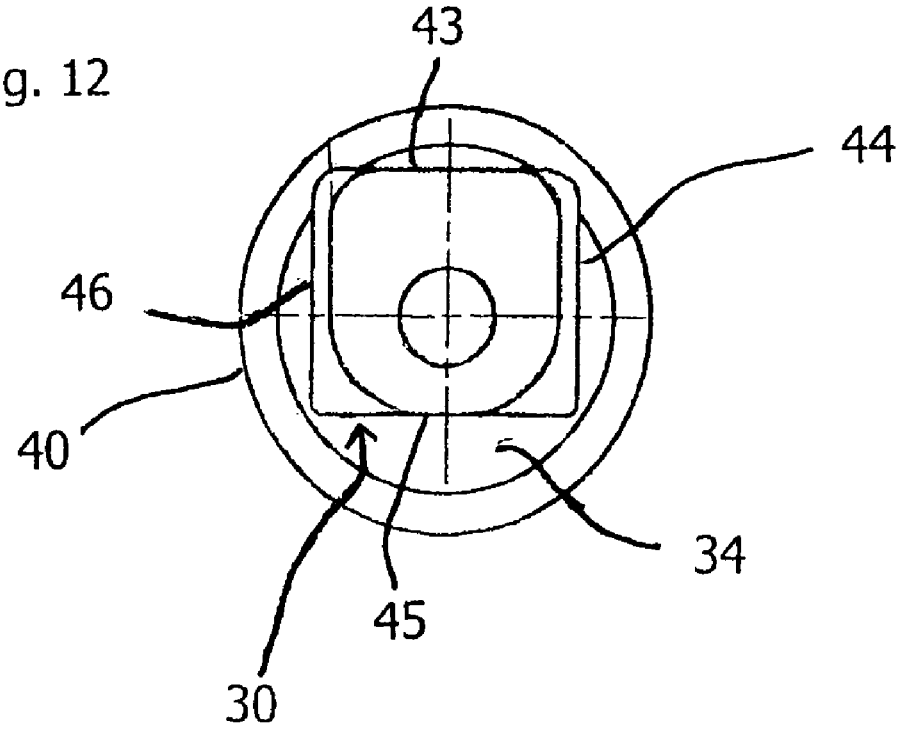
FIG. 12 is a bottom plan view of the sill knob housing of FIG. 8.

In the embodiment of FIGS. 8–12, the knob guide 30 is generally rectangular in cross section, while the shield 32 can be substantially oval or circular in design, forming an outer expanded section which is wider than the knob guide 30. The shield 32 and expanded passage 48 therein extend upwardly from the sill 34. The sill 34 extends between the knob guide 30 and the shield 32, and defines a ledge 47 on the upper surface thereof, as seen in FIGS. 6 & 9. This ledge 47 creates an obstruction to access by any unauthorized tool, such as a thieving device. When a would-be thief attempts to insert a "slim-jim" or other thieving device between the knob guide 30 and the sill knob 27 to contact the base of the lock button 13, the tool encounters the ledge 47 (see FIG. 7). This ledge 47 increases the difficulty in inserting the thieving device between the knob guide 30 and the sill knob 27, and therefore discourages theft.

The sill knob and cable assembly 20 according to the novel design hereof will take potential thieves much longer to get the vehicle opening unlocked. If it takes too much time to unlock the opening, the thieves will move on to another vehicle that is quicker and easier to access.

While this embodiment shows the shield 32 having a circular cross section, it should be understood that other cross sectional shapes would be applicable and could be used. Other cross sections of the shield 32 that would be useful include any cross section that does not match the profile and size of the knob guide 30 and the sill knob 27. For example, and not meant to be a limitation, oval, triangular and any other polygonal shape could be used for the shield 32, as an alternative to the cylindrical shape shown in the drawings.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

The invention claimed is:

1. A vehicle, comprising:

a door having a sill portion;

an anti-theft sill knob and cable assembly for the vehicle, said assembly comprising:

a tubular sheath for protectively surrounding a cable;

a housing attached to an upper end of said sheath for slidably retaining a sill knob therein, said housing being operatively attached to said sill portion and comprising a knob guide having a hollow chamber formed therein and comprising a floor portion with a hole formed therethrough, said knob guide having at least one wall attached to and extending away from said floor portion and cooperating with said floor portion to define said hollow chamber, said housing adapted to be fixedly and non-adjustably installed in a vehicle door;

a sill knob disposed within said knob guide for supporting a lock button thereon, said sill knob comprising a main body and a stud attached to said main body, said main body having a base portion, and being movable between a locked position and an unlocked position, wherein said main body is wider than said stud;

a cable slidably disposed within said sheath and having an upper end attached to said base portion of said sill knob for concurrent movement therewith, said cable extending through the hole in the floor portion of said knob guide; and a connector attached to a lower end of said cable opposite said sill knob;

wherein said housing and said sill knob are respectively configured so that said sill knob is retained above the floor portion of said knob guide;

and wherein said housing further comprises a shield attached to and extending upwardly from an upper portion of said knob guide for protectively shielding said sill knob and for resisting unauthorized access thereto;

wherein the shield is configured to limit access to the sill knob when the sill knob is in the locked position thereof.

2. The vehicle of claim 1, wherein the shield comprises a collar which substantially surrounds a portion of said sill knob.

3. The vehicle of claim 2, wherein the collar is wider than, and has a different cross-sectional shape than the knob guide, and wherein the knob guide has smooth and substantially uninterrupted side walls.

4. The vehicle of claim 2, wherein the housing further comprises a sill extending between said collar and said knob guide.

5. The vehicle of claim 2, wherein the collar is substantially cylindrical.

6. The vehicle of claim 1, wherein the knob guide comprises a substantially rectangular box shape having smooth and substantially uninterrupted side walls.

7. In a vehicle of the type having a door with a sill portion, the improvement comprising an anti-theft sill knob and cable assembly in the vehicle, the assembly comprising:

a sill knob for supporting a lock button and for connecting to a locking mechanism, the sill knob comprising a main body and a stud attached to the main body and having male threads formed externally thereon for supporting a lock button;

a hollow tubular sheath;

a cable slidably disposed within said sheath and having an upper end which is operatively attached to said sill knob;

a housing attached to an upper end of said sheath, said housing comprising:

a knob guide at one end thereof with a chamber formed therein, said knob guide having a floor portion with a hole formed therein;

a collar attached to the knob guide for protectively shielding part of the sill knob, the collar being wider than the knob guide, and a sill extending between the collar and the top of the knob guide and defining a ledge on an upper surface thereof whereby the ledge discourages the insertion of a tool into the chamber;

wherein said housing and said sill knob are respectively configured so that said sill knob is retained above the floor portion of said knob guide.

8. The anti-theft sill knob assembly of claim 7, wherein the collar has a circular cross section.

9. The anti-theft sill knob assembly of claim 7, wherein the knob guide has a rectangular cross section.

10. In a vehicle of the type having a door with a sill portion, a sill knob and cable assembly attached to the sill portion of the door and having a tubular sheath, a cable slidably disposed in the sheath, a sill knob attached to an upper end of the cable, and a hollow housing attached to an upper end of the sheath for slidably containing the sill knob, the improvement comprising:

a shield integrally attached to the housing for limiting unauthorized access to the sill knob, a floor provided as part of said hollow housing to retain the sill knob thereabove, and said sill knob comprising a main body having a first width and a stud attached to the main body and having male threads formed externally thereon for supporting a lock button, wherein said stud has a second width which is narrower than the width of the main body.

11. The improved sill knob and cable assembly of claim 10, wherein the shield comprises a collar for protectively surrounding the sill knob when said sill knob is in a lowered position.

12. The improved sill knob and cable assembly of claim 11, wherein said housing comprises a substantially rectangular box shape, and wherein said collar is substantially cylindrical.

* * * * *